United States Patent [19]

Gagnebin

[11] 4,408,901

[45] Oct. 11, 1983

[54] MINIATURE PUSHBUTTON

[75] Inventor: Gaston Gagnebin, Bienne, Switzerland

[73] Assignee: Societe Suisse pour l'Industrie Horlogere Management Services, S.A., Bienne, Switzerland

[21] Appl. No.: 214,156

[22] Filed: Dec. 8, 1980

[30] Foreign Application Priority Data

Dec. 13, 1979 [FR] France ..... 79 31025

[51] Int. Cl.[3] ..... G04B 29/00

[52] U.S. Cl. ..... 368/321; 368/319

[58] Field of Search ..... 368/319–321, 368/288, 289, 290, 291

[56] References Cited

U.S. PATENT DOCUMENTS 4,122,664 10/1978 Stampi ..... 368/320
4,320,485 3/1982 Baumgartner ..... 368/321

FOREIGN PATENT DOCUMENTS 2722173 1/1977 Fed. Rep. of Germany ..... 368/319
2718345 1/1977 Fed. Rep. of Germany ..... 368/290
54-99676 8/1979 Japan ..... 368/321
348415 3/1942 Switzerland .
303715 2/1955 Switzerland .
348928 10/1960 Switzerland .
2010584 9/1979 United Kingdom .

*Primary Examiner*—Bernard Roskoski
*Attorney, Agent, or Firm*—Griffin, Branigan and Butler

[57] ABSTRACT

The invention concerns a miniature pushbutton for a timepiece and includes a head portion (1) associated with a socket (2) force fitted into a caseband (15). Considered in isolation it constitutes a dormant corrector since it lacks a return spring thus permitting a considerable reduction in its dimensions. The head portion including stem is fashioned in a manner to permit assembly and disassembly from the timepiece exterior thus facilitating these operations. A retention system is provided which prevents inadvertent separation of the head-stem portion from the socket. Such pushbutton may be advantageously employed in extra thin timepieces.

5 Claims, 3 Drawing Figures

MINIATURE PUSHBUTTON

BACKGROUND OF THE INVENTION

This invention concerns a miniature pushbutton for an electronic timepiece and comprises a socket having an innermost extremity terminating in a base portion provided with an opening and a head-stem member integrally formed by a first portion adapted to pass through said opening and a second portion adapted to slide freely in the socket, said second portion including a groove arranged to retain sealing means cooperating with the interior wall of the socket.

Swiss published patent application No. 5 582/74 shows a similar arrangement to that descrived above. A head and a flange between which is placed a toroidal seal form a second portion of the stem which cooperates with a socket force fitted or glued into the case band of the timepiece. The first portion of the stem passes through an opening provided in the base portion of the socket. This first stem portion presents a second flange obtained by a setting operation and intended to retain the stem in the socket against the force of a spring. This arrangement presents at least two disadvantages. Initially the return spring incorporated into the pushbutton takes up considerable space both in length and in diameter and is thus not suitable for the obtaining of a miniature pushbutton. Additionally the setting operation on the stem renders dissassembly impossible which may hinder the operation of assembling and dissassembling the watch.

A solution for overcoming this latter disadvantage has already been suggested in Swiss Pat. No. 303 715. Here, and as may often be the case, the movement is of smaller diameter than the case-band in which it is arranged and its dial being supported on an interior shoulder of the case band-bezel oversteps this movement. In such case the first portion of the stem of the pushbutton after having passed through the opening at the base of the socket provides only a small projection at the interior of the case. The junction between the second portion of the stem and the member to be actuated on the movement is obtained by an extension which is assembled after the movement has been set into the case. If an enlarging cage or circle is employed in order to adjust a small movement to a case of larger diameter, such junction may be realized by piercing a hole in the circle or cage and introducing therein an extension. In addition to the fact that this patent does not provide a solution to the miniaturization of the pushbutton (since a return spring is always necessary), it entails the difficulty of a complicated construction obliging the utilization of additional parts and renders more difficult the operations of assembly and dissassembly of the timepiece.

It is becoming more and more common to provide timepieces of greatly reduced dimensions, above all in respect of the thickness thereof. In such a case one has available very little space in the thickness as represented by the case-band and the pushbutton corrector must be on the scale of the timepiece in which it is mounted, that is to say it must also be of very small dimensions. After a certain miniaturization has been realized it is no longer possible to provide a return spring forming an integral portion of the pushbutton since the force available therefrom would be incapable of returning the head to its initial position prior to actuation. In such a timepiece it is equally desirable to reduce to the extent possible the number of mechanical parts in order to lower the cost and as well as to facilitate assembly. The means described in the cited patent and patent application do not permit achieving the objects of this invention which are the miniaturization of the pushbutton through elimination of its return spring, easy assembly of the said pushbutton by introduction of its stem from the exterior of the case and security of operation by a system preventing the stem from inadvertent separation from the socket in which it is mounted.

These object are attained by means of the construction as claimed.

DETAILED DESCRIPTION OF THE DRAWINGS

Figure 1:
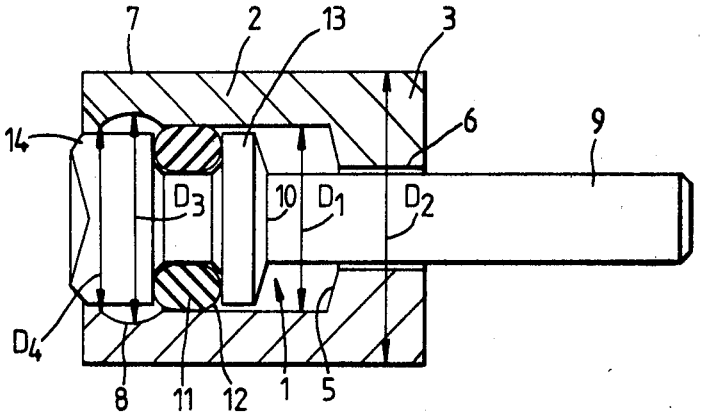
FIG. 1 shows a greatly enlarged cross section of the miniature pushbutton according to the invention taken in isolation before its insertion in the case-band of the timepiece.

FIG. 1 shows the miniature pushbutton according to the invention. It comprises a head-stem member 1 cooperating with a socket 2. The interior diameter D1 of the socket is constant over its entire length with the exception of a region where there is to be found a sink 8 the function of which will be subsequently explained. At its innermost extremity 3 the socket is terminated by a base 5 in which is provided an opening 6. In one realization according to the invention the exterior diameter D2 of the socket may be of very small dimensions for instance 1.5 mm, its interior diameter D1 on the order of 1 mm and its overall length on the order of 1.8 mm. A boring operation of the interior surface of the socket permits obtaining the desired finish. Proximate the open outer extremity of the socket and on its interior wall there is provided a circular groove forming a sink 8. This sink is formed by machining the internal wall to the diameter D3. The arrangement is such that diameter D4 is substantially equal to the interior diameter D1 of the socket.

Figure 2:
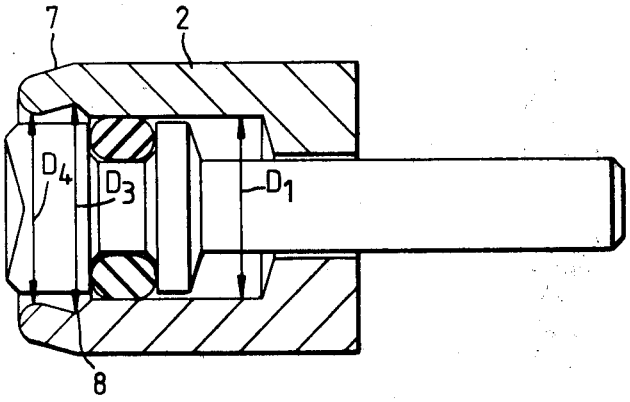
FIG. 2 is a preferred variant of the miniature pushbutton according to the invention.

FIG. 2 shows a preferred variant of the obtaining of the sink 8. In order to obtain this sink, initially the wall of the socket is weakened by machining in order to increase its interior diameter to a dimension D3, then with the help of a suitable tool, the extremity 7 of the socket is constricted in order to form a diameter D4 substantially equal to the interior diameter D1 of the socket.

On returning to FIG. 1 it will be seen that the head-stem of the miniature pushbutton comprises two distinct portions formed as a single piece. The first portion 9 of the head-stem, taking form in the interior of socket 2, passes through opening 6 and is extended outwardly from the socket towards the interior of the timepiece. It will be noted that the diameter of this first portion is constant over its entire length and that it is devoid of settings or bulges normally necessary to limit the travel of the stem towards the left. The second portion 10 of the head-stem 1 of greater diameter than the first portion 9 is adapted to slide freely in the interior of the socket 2. This second portion comprises a groove 11 which serves to retain a seal member 12, this latter cooperating with the internal wall of socket 2. Groove 11 defines a flange 13 intended to limit the course of the stem at the base of the socket, and a head 14 intended to be actuated, for example, with the tip of a ball point pen.

As thus described and in isolation, this pushbutton comprises a dormant corrector since it is devoid of a return spring. From the position as depicted the stem may be pushed towards the right until flange 13 butts against base 5. It will be understood that this construction permits an appreciable reduction of the length of the socket since no space is required for a return spring normally disposed between the flange 13 and the base 5 as in the prior art. Thus the distance separating the flange from the base is determined only by the travel necessary to cause an electrical contact. In the same manner the absence of the return spring enables a substantial reduction of the overall diameter D2 of the socket. It will be understood in effect that for the reduced dimensions proposed, a spring would likewise have to be formed from reduced diameter wire, this resulting in a return force insufficient to overcome the friction between the seal 12 and the internal wall of diameter D1.

Figure 3:
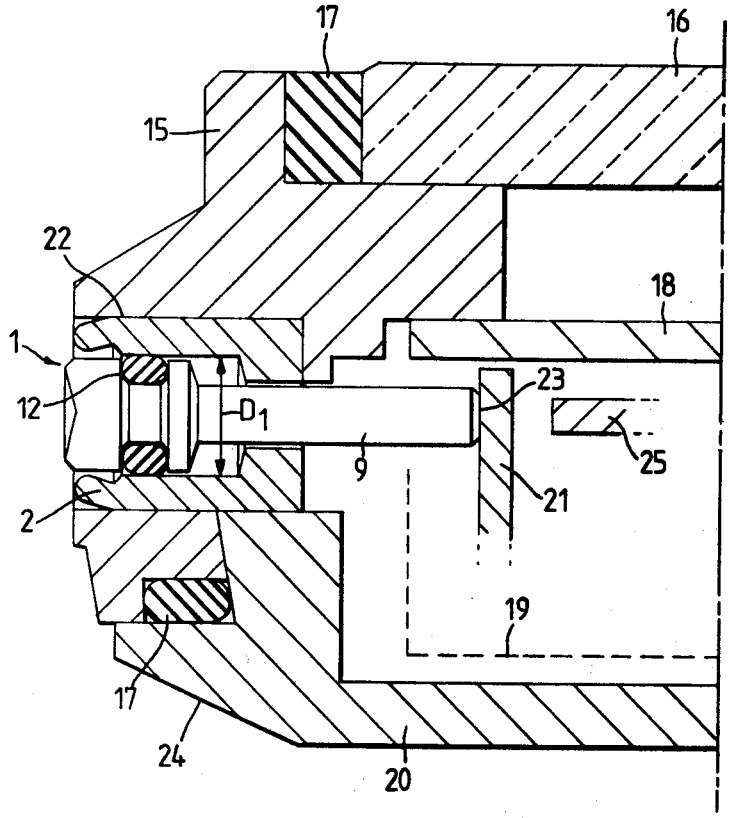
FIG. 3 is a cross section showing the pushbutton assembled in the case-band of the timepiece.

FIG. 3 shows how the miniature pushbutton is mounted in the timepiece. In this figure is shown case-band 15, crystal 16, seals 17, dial 18, movement 19 and the back cover 20 of the timepiece. Integral with movement 19 there is a contact 25 which forms the input terminal of an electric circuit by which may be obtained for instance the time setting or date setting of the watch when this terminal is grounded. A spring blade 21 effects this grounding when it comes into contact with terminal 25. In case-band 15 an opening 22 is provided in which is force fitted or glued socket 2 of the pushbutton. The axis of the opening 22 is arranged in order to be aligned with the spring blade 21.

The movement 19 with its dial 18 is introduced into the case-band 15, then the bottom cover is placed in order to close the timepiece. At this time, via the exterior, the head-stem 1 of the pushbutton is introduced into the socket 2 until the extremity 23 of the stem portion touches spring blade 21. The operations of time setting or date setting are obtained by urging the head-stem into the socket 2 by means of a ball point tip for example and according to the programme established for the module mounted in the case. This action causes the spring blade to bend until it comes into contact with terminal 25. If pressure is relaxed on the head the latter will return to its initial position as shown in FIG. 3. It is to be here noted that the return spring force of spring blade 21 must be greater than the friction force between the seal member 12 and the wall D1 of socket 2. In an example according to the invention this force is chosen to be around 6 N if the friction force is on the order of 3 N. In the same manner the distance separating flange 13 from the base (see FIG. 1) is chosen to be around 0.5 mm, this corresponding to a distance very slightly greater than that necessitated by the travel of spring blade 21 in order to come into contact with terminal 25. Since head-stem 1 must be capable of introduction from the exterior of the watch the stem portion 9 does not have a bulge for limiting its travel towards the left (see FIG. 1) as has been explained. It follows that the head-stem could come out of the socket inadvertently following a shock for instance. The invention proposes a security arrangement represented by the sink 8 already described. In a rest position the head-stem 1 is positioned relative to the socket as shown in FIG. 1 or 2. It will now be understood that if the stem were to be accidently displaced towards the left the seal member 12, in view of the pressure exerted by its elasticity against the wall of the socket 2, will come to lodge itself by expanding into the sink 8, this having an effect to stop immediately the movement of head-stem 1.

The description which has just been given of a miniature pushbutton according to the invention now enables a better appreciation of the advantages set forth in the introduction.

In the example already mentioned, the diameter of the stem portion 9 of the head-stem may be reduced to about 0.5 mm. Thus in timepieces of very small thickness the pushbutton may be positioned high enough on the case-band to permit a bevel 24 on the bottom cover of the case (see FIG. 3). In the mentioned example the stem portion 9 of the head-stem is situated only about 0.1 mm below dial 18. There may arrive cases where the contact 25 is found in a lower portion of movement 19. The extreme miniaturization of the pushbutton will then permit placing the latter completely at the bottom of the case if necessary in a boss provided on the bevel 24.

Head-stem 1 may be introduced from the exterior into the socket 2 following casing of the watch. If, as in the cited patent CH No. 303 715, the movement is of smaller diameter than the case-band in which it is placed the contact 25 will be situated further towards the interior of the case and the length of stem 1 will be adapted to the distance separating the orifice of the pushbutton from this contact. By virtue of the introduction of the head-stem after casing there will be no longer the difficulty of choosing a dial which projects beyond the movement. If an enlarging circle or cage is employed it will equally be understood that an extension is no longer necessary. Finally, for dissassembling of the timepiece the head-stem of the pushbutton will be withdrawn towards the exterior by means of a special tool provided for this purpose.

What we claim is:

1. A miniature pushbutton for an electronic timepiece comprising a socket forming means defining a socket having its innermost extremity terminating in a base portion provided with an opening and a head-stem member integrally formed by a first portion adapted to pass through said opening and a second portion adapted to slide freely in the socket, said second portion including a groove arranged to retain a sealing means and a sealing means mounted in said groove for cooperating with the interior wall of the socket to allow relatively easy movement of said second portion in said socket, said pushbutton being of a dormant corrector type, the return movement thereof being assured by means entirely external thereto, the diameter of said first portion being constant and said socket forming means including a retaining means proximate the outermost extremity of the socket for cooperating with said sealing means to prevent said relatively easy movement of said second portion in said socket and thereby preventing inadvertent separation of said head-stem member from said socket.

2. A miniature pushbutton as set forth in claim 1 wherein said socket forming means includes a surface means for being force fitted into an opening in a case-band or back cover of a timepiece the length of said first portion of the head-stem member being determined so that the inner extremity thereof may act directly on an arrangement of electrical contacts forming part of the timepiece movement or module.

3. A miniature pushbutton as set forth in claim 1 wherein said retaining means comprises a groove formed in the interior wall of the socket, said sealing means being arranged with friction fit against the interior wall of said socket so as to be slidable to the point where it arrives at and lodges in the groove thereby preventing said inadvertent separation.

4. A miniature pushbutton as set forth in claim 3 wherein said groove is obtained by machining the interior wall of the socket.

5. A miniature pushbutton as set forth in claim 3 wherein said groove is obtained by initially increasing the interior diameter of the outer extremity of the socket by machining and thereafter constricting said outer extremity.

* * * * *